US006501229B2

(12) United States Patent
Ogawa et al.

(10) Patent No.: US 6,501,229 B2
(45) Date of Patent: Dec. 31, 2002

(54) GRAPHIC FLUORESCENT DISPLAY DEVICE

(75) Inventors: Yukio Ogawa, Mobara (JP); Katsutoshi Kougo, Mobara (JP); Kazuyoshi Ishikawa, Mobara (JP); Hiroaki Kawasaki, Mobara (JP)

(73) Assignee: Futaba Denshi Kogyo Kabushiki Kaisha, Chiba (JP)

( * ) Notice: Subject to any disclaimer, the term of this patent is extended or adjusted under 35 U.S.C. 154(b) by 26 days.

(21) Appl. No.: 09/872,570

(22) Filed: Jun. 1, 2001

(65) Prior Publication Data

US 2002/0011794 A1 Jan. 31, 2002

(30) Foreign Application Priority Data

Jun. 1, 2000 (JP) ..... 2000-164448

(51) Int. Cl.[7] ..... G09G 3/10

(52) U.S. Cl. ..... 315/169.3; 315/169.1; 313/503

(58) Field of Search ..... 315/169.1, 169.3, 315/169.2, 350, 375; 313/497, 503, 510; 340/772, 781

(56) References Cited

U.S. PATENT DOCUMENTS 4,218,636 A * 8/1980 Miyazawa ..... 315/169.1
4,459,514 A * 7/1984 Morimoto et al. ..... 315/169.3
6,392,356 B1 * 5/2002 Stevens ..... 315/169.3

* cited by examiner

*Primary Examiner*—Don Wong
*Assistant Examiner*—Jimmy T Vu
(74) *Attorney, Agent, or Firm*—Katten Muchin Zavis Rosenman

(57) ABSTRACT

A fluorescent display device includes a first substrate, an insulating layer formed on the first substrate, n columns of m anodes, each anode having a fluorescent layer thereon, Q anode lead wires provided for each column of the m anodes, every Qth anodes being connected to a same anode lead wire, and m/Q grids, formed on the insulating layer, each grid being arranged across the n columns of m anodes, each grid being provided with openings for each column of m anodes, each opening exposing a portion of the first substrate and one anode being formed on the exposed portion of the first substrate.

6 Claims, 8 Drawing Sheets

GRAPHIC FLUORESCENT DISPLAY DEVICE

FIELD OF THE INVENTION

The present invention relates to a graphic fluorescent display device; and, more particularly, to a graphic fluorescent display device incorporating therein a planar grid.

BACKGROUND OF THE INVENTION

FIGS. 1A to 2B provide schematic views for illustrating the arrangements and operation methods of anodes and grids of conventional graphic fluorescent display devices.

FIG. 1A is a top view for showing the arrangement of the anodes and the grids, in which reference notations A11 to A52 represent anodes; G1 to G5, the grids; A1 and A2, two anode lead wires. And in FIG. 1A, only three rows of the anodes and five grids are described. Every second anodes in a same row are connected to a same anode lead wire. When viewed from top of the fluorescent display device, the anodes, grids and filaments (not shown) are vertically disposed in that order while maintaining certain distances therebetween. Electrons emitted from the filaments pass through the grids G1 to G5 and reach the anode A11 to A52.

In FIG. 1A, the grid G1 controls the anodes A11 and A12 and the gird G2 does the anodes A21 and A22. The grids G3 to G5 also function similarly.

FIG. 1B is a schematic view for explaining operation scheme of the graphic fluorescent display device shown in FIG. 1A.

For instance, in order to turn on the anode A22 to emit light, negative voltages are respectively applied to the grids G1, G3, G4 and G5 and the anode lead wire A1, while a positive voltage is respectively applied to the grid G2 and the anode lead wire A2. The electrons emitted from the filament can pass through the grid G2 but cannot pass through the remaining grids G1, G3, G4 and G5 since the electrons moving toward the grid G1, G3, G4 and G5 are repulsed by the negative electric fields created by negative voltages applied thereto. The electrons passing through the grid G2 can reach the anode A22 to which positive voltage is applied but cannot reach the anode A21 to which negative voltage is applied.

Since, however, the electrons moving toward the anode A22 are affected by the negative electric field generated by the grid G3 of negative potential, the electrons may not reach an edge part of the anode A22 adjacent to the grid G3. As a result, there occurs the so-called eclipse phenomenon where an anode has a dark spot at the edge adjacent to a neighboring grid.

Referring to FIG. 1C, there is illustrated another conventional graphic fluorescent display device having anodes controlled by three anode lead wires A1 to A3 wherein every third anodes are connected to a same anode lead wire.

For instance, if negative voltages are applied to grids G1, G3 and G4, while a positive voltage is applied to the grid G2, electrons emitted from filaments can pass through only the grid G2 as shown in FIG. 1C. Further, if the anode lead wires A1 and A3 are of positive potentials, the electrons can reach the anodes A22 and A32. In this case, since the electrons moving toward the anodes A22 and A32 are affected by negative electric fields generated by the grids G1 and G3 of negative potentials, the electrons may not reach an edge part of the anode A22 adjacent to the anode G1 and an edge part of the anode A32 adjacent to the anode G3. Therefore, such edge parts do not emit sufficient light, which results in dark streaks thereat (See, e.g., Japanese Laid-Open Publication Number JP63-35037).

Referring to FIGS. 2A and 2B, there are illustrated conventional operation methods employed in order to prevent the non-uniformity in the brightness of the fluorescent display device described above with reference to FIGS. 1A to 1C.

In FIGS. 2A and 2B, there are four anode lead wires A1 to A4 and every fourth anodes are connected to a same anode lead wire. Each of the grids G1 to G5 controls two anodes.

In FIG. 2A, the grids G2 and G3 are of positive potentials and the grids G1, G4 and G5 are of negative potentials. Since the anodes A22 and A31 are selected to emit light, the anode lead wires A1 and A4 are of positive potential. In this case, since the anodes A22 and A31 are away from the grids G1 and G4, the negative electric fields created by the grids G1 and G4 scarcely influence the passages of the electrons emitted from filaments to the anodes A22 and A31.

The arrangement of the anodes, the grids and the anode lead wires shown in FIG. 2B is identical to the one shown in FIG. 2A, but grid selection scheme is different from that of FIG. 2A.

In FIG. 2B, positive potentials are applied to the grids G2, G3 and G4 and negative potentials are applied to the grids G1 and G5. Since the anodes A31, A32 controlled by the grid G3 are selected to be turned on, positive potentials are applied to the anode lead wires A1 and A2. In this case, since the anodes A31 and A32 are away from the grids G1 and G5 of negative potential, the negative electric fields created by the grids G1 and G5 hardly influence the passages of the electrons emitted from the filaments to the anodes A31 and A32. Further, the effect of the negative electric fields created by the grids G1 and G5 is less than that described in FIG. 2A (See, e.g., Japanese Laid-open Publication supra).

In FIGS. 1A to 1C, the non-uniformity in the brightness due to electronic fields of neighboring grids may not be avoided. Such a non-uniformity problem can be avoided by the control schemes as shown in FIGS. 2A and 2B. However, the configurations of FIGS. 2A and 2B require one grid for every two anodes, even though the anodes are controlled by four anode lead wires. Resultantly, still a large number of grids are required, complicating the structure of a fluorescent display device with a large number of drivers of the grids. Further, a duty factor becomes lower to thereby decrease the luminance level of the device.

SUMMARY OF THE INVENTION

It is, therefore, an object of the present invention to eliminate the above-mentioned disadvantages of the prior art.

In accordance with the present invention, there is provided a fluorescent display device including:

a first substrate;

an insulating layer formed on the first substrate;

n columns or rows of m anodes, each anode having a fluorescent layer thereon;

Q anode lead wires provided for each column or row of the m anodes, every Qth anodes being connected to a same anode lead wire; and z grids, z being a positive integer equal to or greater than m/Q but smaller than (m/Q)+1, formed on the insulating layer, each grid being arranged across the n columns of m anodes, each grid being provided with openings for each column or row of m anodes, each opening exposing a portion of the insulating layer and one anode being formed on the exposed portion of the insulating layer, wherein the insulating layer, the anodes, the anode lead wires and grids are thin films.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Figure 3:
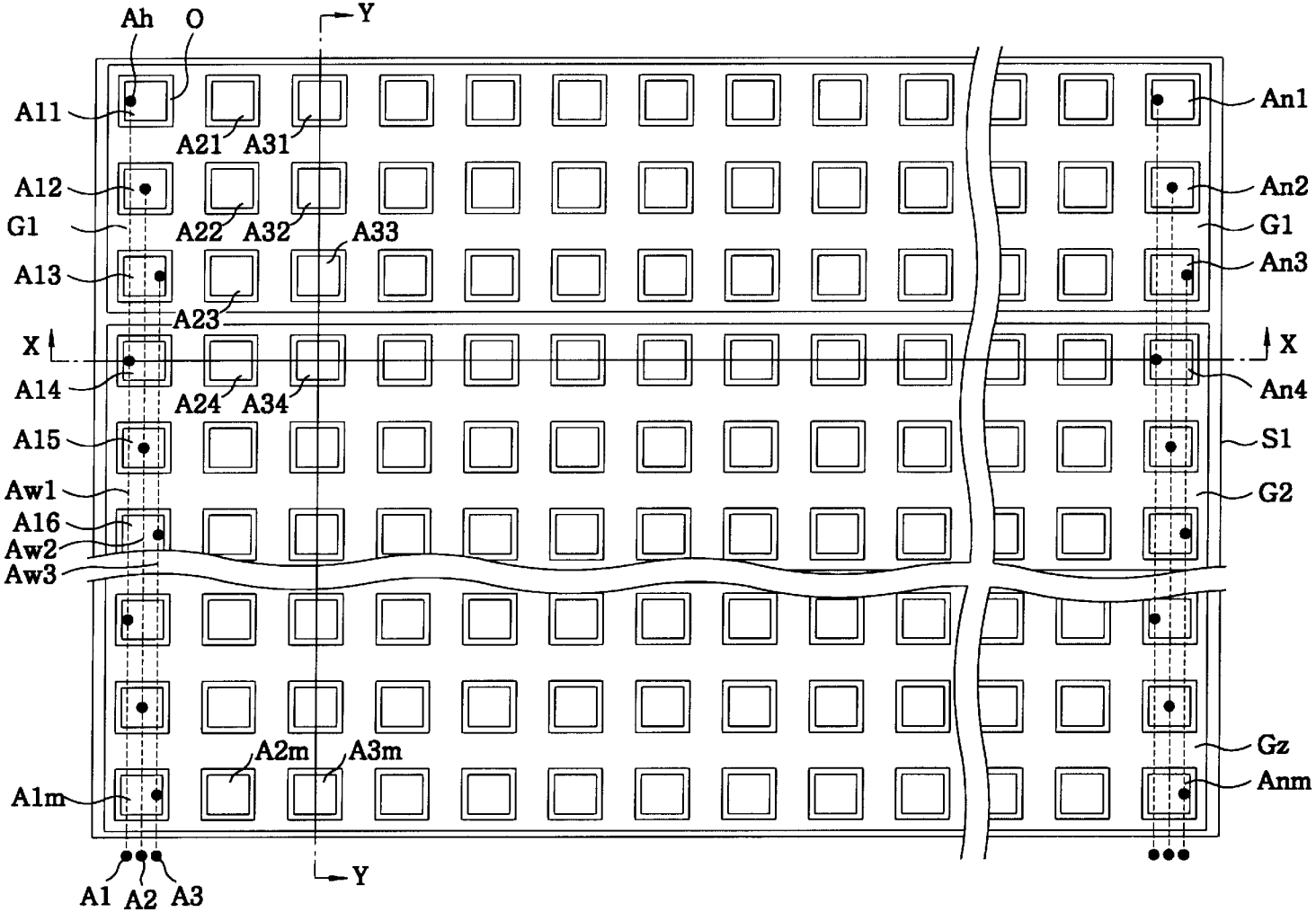
FIG. 3 shows an arrangement of anodes and grids of a graphic fluorescent display device in accordance with a first preferred embodiment of the present invention.

FIG. 3 shows the arrangement of anodes and grids of a graphic fluorescent display device in accordance with a first preferred embodiment of the present invention.

Figure 1A:
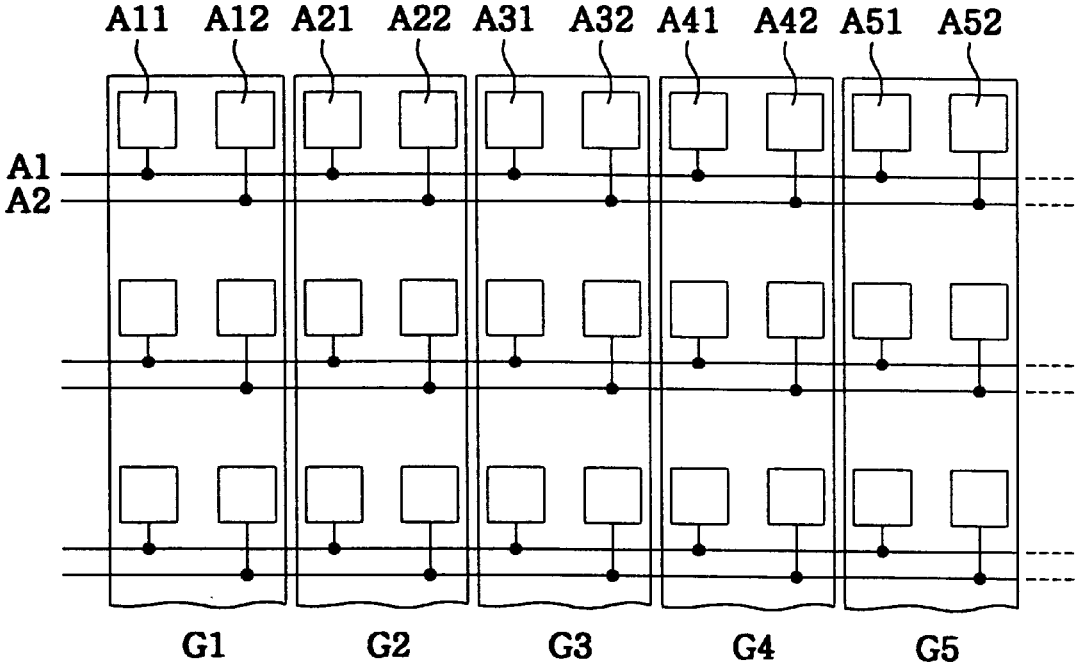
FIG. 1A (PRIOR ART)
FIGS. 1A to 1C show schematic views for illustrating arrangements and operation schemes of anodes and grids of conventional graphic fluorescent displays.
Figure 1B:
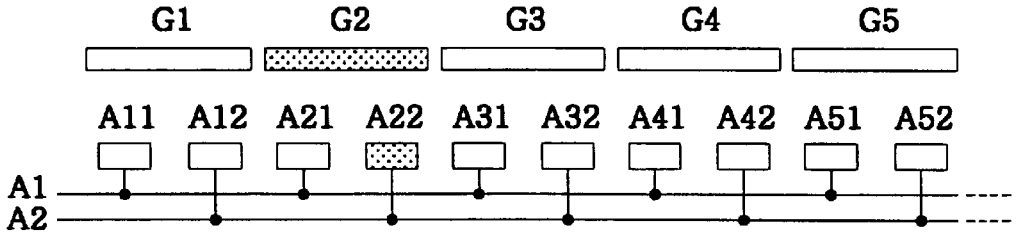
FIG. 1B (PRIOR ART)
Figure 1C:
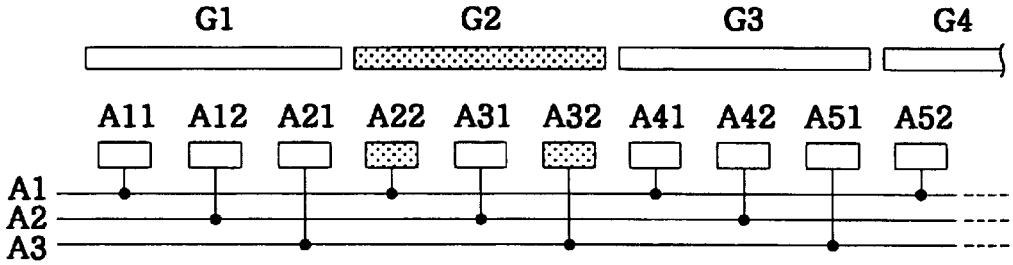
FIG. 1C (PRIOR ART)

Reference notations S1, A11 to A1*m* and An1 to Anm, G1 to Gz, O, Aw1 to Aw3, A1 to A3 and Ah shown in FIG. 1 respectively represent a first substrate formed of a glass material, anodes each having a fluorescent layer deposited thereon, thin film grids, openings formed in the grids, thin film anode lead wires, terminals of the anode lead wires and through-holes.

The anode lead wires Aw1 to Aw3 are provided on the first substrate S1, and the through-holes Ah are formed in a thin insulating layer D (FIG. 4) provided between the anodes and the anode lead wires. The through-holes Ah are located under the anodes A11 to Anm, but are depicted in FIG. 3 to schematically show electrical connections between the anodes and the anode lead wires.

The grids G1 to Gz are provided on the insulating layer D (FIG. 4) formed on the first substrate S1 and anodes A11 to Anm are formed on the insulating layer D exposed through the openings O in the grids. The anodes A11 to Anm are electrically connected with the anode lead wires Aw1 to Aw3 through the through-holes Ah in the insulating layer D.

The anodes A11 to Anm are made of n columns each having m anodes. Anodes in each column are coupled to Q, e.g., 3 anode lead wires, and every Qth anodes are electrically connected to a same anode lead wire through a conductive material filled in through-holes therebetween.

The number of grids is z=m/Q and Q anodes from each column of anodes are allotted to each grid. If m/Q is not an integer, Z is set to be a smallest integer greater than m/Q.

In this embodiment, Q is three, and so every third anodes in each column are electrically connected to a same anode lead wire Aw1, Aw2 or Aw3 through the conductive material filled in the corresponding through-holes. The anodes in each column of anodes are allotted to and controlled by z (z=m/3) grids. For example, anodes A11 to A13 and anodes A14 and A16 in first column of anodes are respectively controlled by the grids G1 and G2.

The number of column of anodes, i.e., n, the number of anodes in each column of anodes, i.e., m, the number of grids, i.e., z=m/Q and the number of anodes controlled by each grid, i.e., Q are determined depending on, e.g., the display area and the resolution.

Figure 4A:
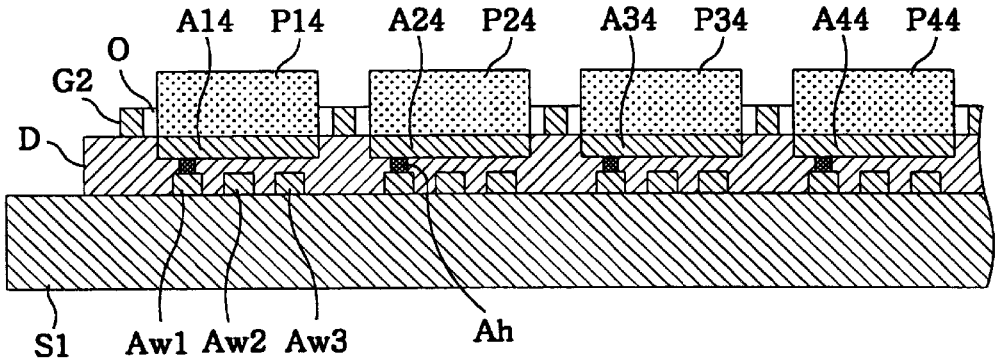
FIGS. 4A and 4B illustrate a partial cross sectional views of the graphic fluorescent display shown in FIG. 3.
Figure 4B:
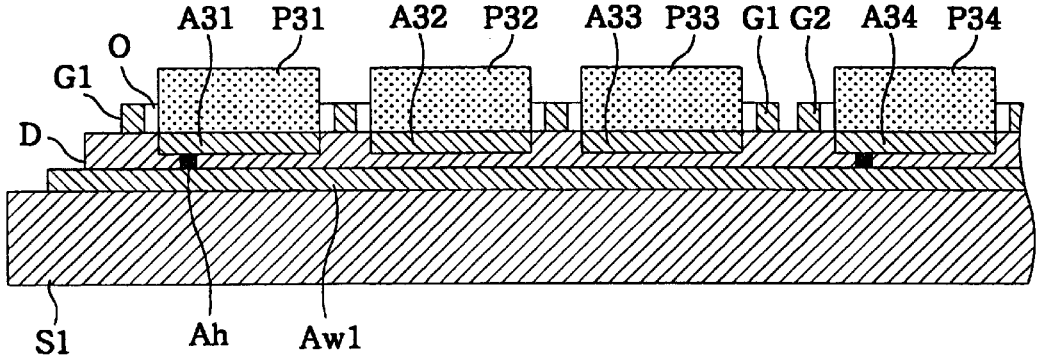

FIGS. 4A and 4B respectively illustrate enlarged cross sectional views taken along the lines X—X and Y—Y in FIG. 3 respectively.

Reference notations S1, D, A14 to A44 and A31 to A34, P14 to P44 and P31 to P34, G1 and G2, O, Aw1 to Aw3 and Ah used in FIG. 4 respectively represent the first substrate, the insulating layer, anodes, fluorescent layers, grids, openings in the grids, anode lead wires and the through-holes filled with the conductive material.

The grids G1 and G2 having, for instance, rectangle shaped openings O therein, are provided on the insulating layer D. The anodes A14 to A44 and A31 to A34 respectively having fluorescent layers P14 to P44 and P31 to P34 coated thereon are disposed on the insulating layer D exposed through the openings O. The anodes A14 to A34 are electrically connected to the anode lead wires Aw1 to Aw3 through the conductive material filled in the through-holes Ah, wherein the three anode lead wires Aw1 to Aw3 are provided to each column of anodes. In FIG. 4A, the anodes A14, A24, A34, A44 are connected to the anode lead wire Aw1 for each corresponding column. In FIG. 4B, every third anodes, e.g., anodes A31, A34, are connected to the anode lead wire Aw1.

There are filaments (not shown) above the anodes A14 to A44 and A31 to A34 and electrons emitted from the filaments are controlled by the grids G1 and G2 to be radiated onto the selected anodes. Since surfaces of grids G1 and G2 facing the filaments are lower than surfaces of the fluorescent layers P14 to P44 and P31 to P34 facing the filaments, a charge-up level of exposed insulating layer D caused by the electrons emitted from the filaments is low and an eclipse phenomenon is reduced. Consequently, the non-uniformity in the brightness due to charged electrons is ameliorated.

Figure 2A:
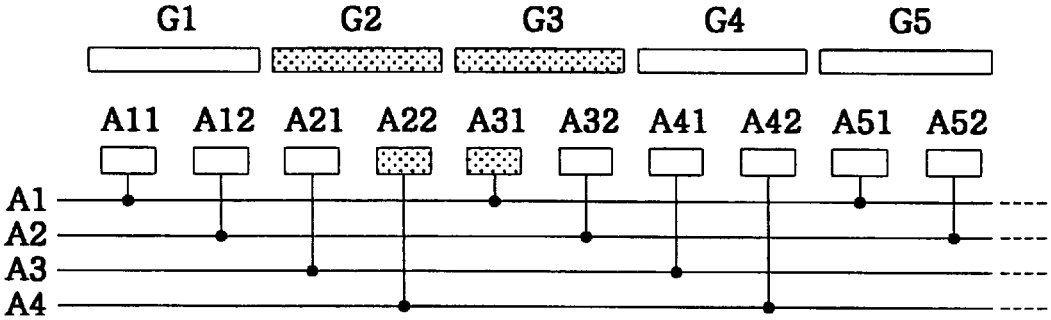
FIG.2A (PRIOR ART)
FIGS. 2A and 2B are schematic views for illustrating arrangement and operation schemes of anodes and grids of another conventional graphic fluorescent display.
Figure 2B:
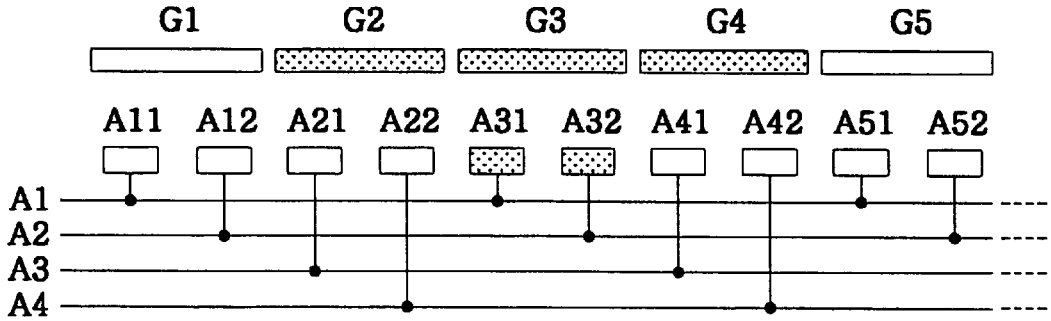
FIG.2B (PRIOR ART)

Further, when the grids G1 and G2 are respectively biased by positive and negative potentials and the anode A33 is selected to emit light, the electrons emitted towards the anode A33 are less affected by the negative electric field created by the grid G2. Accordingly the light emission non-uniformity of the anode A33 is also reduced. As illustrated in FIGS. 1A and 1B, the adverse effect of the negative electric fields created by the neighboring grids could not be avoided in the conventional graphic fluorescent display devices. Further, unlike the conventional fluorescent display device in FIGS. 2A and 2B having grids each controlling two anodes in each column of anodes even though those anodes are coupled with four anode lead wires, there is no limitation in the number of anodes for each column controlled by each grid. The number of anodes controlled by each grid can be identical to that of the anode lead wires. Therefore, the number of grids can be reduced, resulting in the increased duty factor and the luminance level. In addition, there is no need to apply positive voltages to more than one grids simultaneously, simplifying the grid driving method.

Figure 5A:
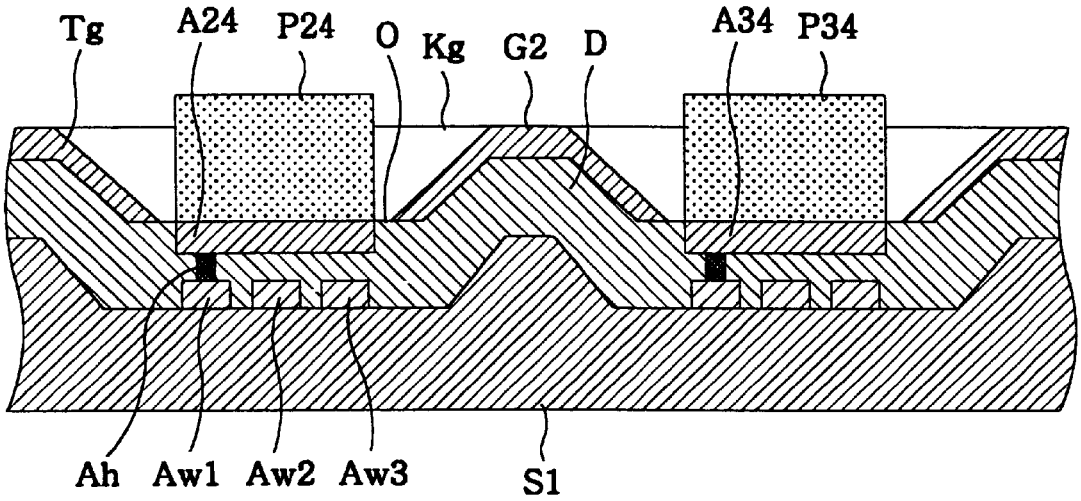
FIGS. 5A and 5B offer a partial cross sectional views of the graphic fluorescent display device shown in FIG. 3 in accordance with second preferred embodiment of the present invention.
Figure 5B:
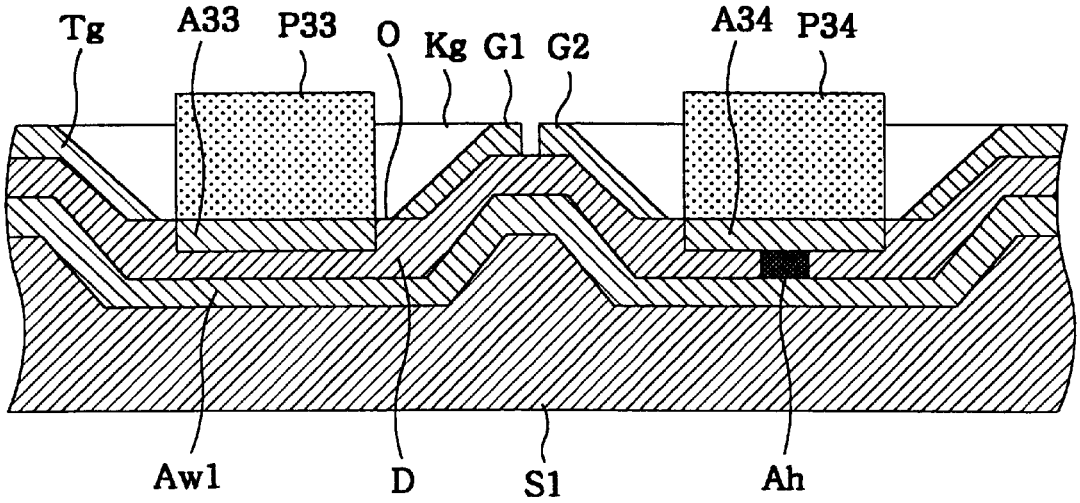

Referring to FIGS. 5A and 5B, there are illustrated partial cross sectional views of the graphic fluorescent display device shown in FIG. 3 in accordance with second preferred embodiment of the present invention. FIGS. 5A and 5B are partial enlarged cross sectional views taken along the lines X—X and Y—Y in FIG. 3 respectively. The arrangements of elements shown in FIGS. 5A and 5B are identical to those shown in FIG. 4 excepting that there are provided recesses on the first substrate S1 where the anodes are formed.

Reference notations used in FIGS. 5A and 5B are identical to those in FIGS. 4A and 4B. The first substrate S1 is provided with a plurality of recesses on which the anodes A24, A33 and A34 are formed. The anode lead wires Aw1 to Aw3 are provided on the substrate S1 having the recesses and then the insulating layer D is formed thereon. The anodes A24, A33 and A34 and grids G1 and G2 are provided on the insulating layer D simultaneously as shown in FIGS. 5A and 5B. The grids G1 and G2 have recessed portions Kg having a similar shape to that of the recesses formed in the substrate S1. The recessed portions Kg are substantially overlapped with the recesses formed on the first substrate S1. The recessed portions Kg have slanted side walls Tg and openings O formed on the bottom each of the recessed portions Kg. The anodes A24, A33 and A34 each having a fluorescent layer deposited thereon are provided on the insulating layer D exposed through the openings O formed in the grids.

In FIGS. 5A and 5B, since surfaces of grids G1 and G2 facing the filaments are lower than surfaces of the fluorescent layers P24, P33 and P34 facing the filaments, the charge-up level of the exposed insulating layer D caused by electrons emitted from the filaments becomes lower and the light emission non-uniformity problem becomes ameliorated.

However, same result can be obtained even in the case where the surfaces of grids G1 and G2 facing the filament are in substantially the same level as the surfaces of the fluorescent layers P24, P33 and P34. Moreover, same result can be obtained even if the surfaces of grids G1 and G2 facing the filament are somewhat higher than those of the fluorescent layers P24, P33, P34, since very small part of the insulating layer D is exposed through the openings O.

Since the grids G1 and G2 shown in FIGS. 5A and 5B have the slanting side walls Tg in the recessed portions Kg, the cur-off characteristic of the grids can be enhanced and the area of the insulating layer exposed through the openings is decreased. Consequently, the charge-up level of the exposed insulating layer D caused by the electrons emitted from the filaments becomes lower.

In the present invention, the insulating layer D is made to be thin such that the thickness thereof is below tenth of that of prior art thick insulating layers, which in turn further decreases the charge-up level of the exposed insulating layer D.

The anodes, grids, insulating layer, and fluorescent layer of the present invention are thin films and the thicknesses of the anodes, grids and insulating layer are substantially equal to or smaller than the size of particles constituting the fluorescent layers. Therefore, if the fluorescent layers are made to be formed of two or more layers of particles, the thickness of the fluorescent layers can become undesirably too thick compared with those of anodes, grids and insulating layer. However, in accordance with the present invention, the relative levels of the grids and the fluorescent layers can be adjusted properly by varying the depth of the recesses formed in the substrate S1. The slanting side walls Tg may be unnecessary in terms of adjusting the levels of the grids and the fluorescent layers since the level adjustment can be controlled by the depth of the recesses. However, it is preferable to have the slanting side walls in order to improve cut-off characteristic, decrease the charge-up level and to prevent the open circuit in the anode lead wires and the grids.

The recesses of the substrate S1 in accordance with the preferred embodiment of the invention are preferably to have a rectangular shape. However, the recesses can be made to have a stripe shape. In this case, the levels of the portions of the grids formed on the bottom of the stripe-shaped recesses become lower, which can degrade the cut-off property of the grids a little bit. However, it does not cause any serious practical problems when used.

Figure 6:
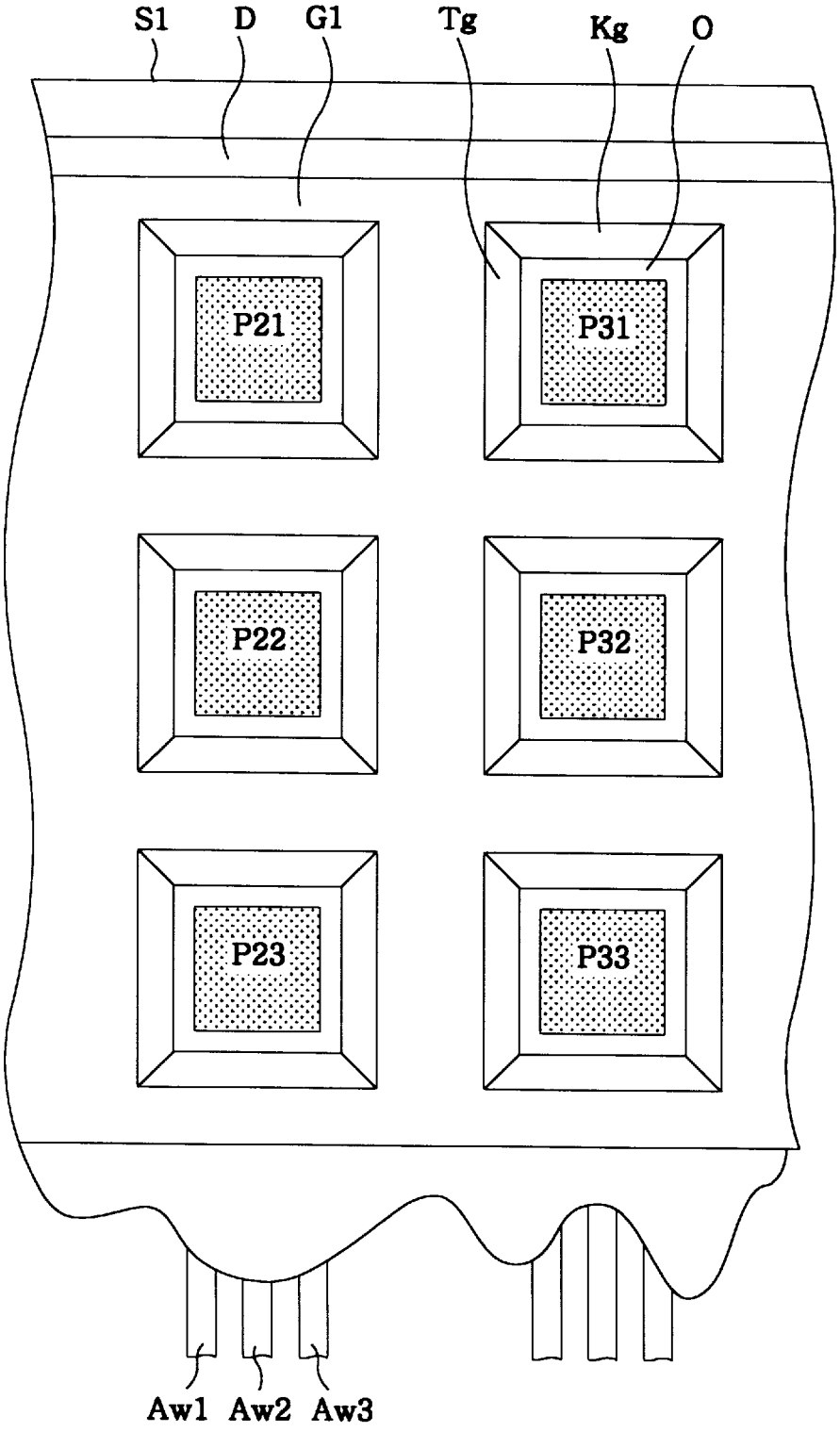
FIG. 6 presents a partial enlarged top view of FIG. 5 of the graphic fluorescent display device in accordance with the second embodiment of the present invention.

FIG. 6 is a partial enlarged plan view of the graphic fluorescent display device in accordance with the second preferred embodiment of the present invention and mainly shows the two columns of recessed portions Kg formed in the grid G1. As shown, the anodes A21 to A23, A31 to A33 (not shown) are provided on the insulating layer D exposed through the openings O and the fluorescent layers P21 to P23 and P31 to P33 are provided thereon. Portions of the insulating layer are exposed through the openings O. Since, however, the slanting side walls Tg cover almost the recessed portions Kg and the exposed portions of the insulating layer D are lower than the surfaces of the fluorescent layers P21 to P23 and P31 to P33 and the grid G1, the adverse effect of the charge-up of the insulating layer can be negligibly small.

In FIGS. 3 to 6, the anodes and the openings of grids have been described to have a square shape, yet they can be of any other shapes such as a circle or a polygon. In addition, an electron source can be a hot cathode, i.e., the filament, as described in the preferred embodiments or a cold cathode, e.g., field emission type cathode.

Furthermore, since the insulating layer D shown in FIGS. 4A to 6 also functions as a black matrix, it is not necessary to install an additional black matrix.

An exemplary method of forming a fluorescent display device in accordance with the present invention will now be expounded.

First, Al layer was deposited on the first substrate S1 (in this example, the thickness of the first substrate was 1.1 mm) formed of glass material by a sputtering method. The preferable thickness of the Al layer is in the range from 0.1 $\mu$m to several $\mu$m, and in this example the thickness was 1.5 $\mu$m. Three anode lead wires for every column of anodes were formed from the Al layer by a photolithographic method. The width of each of the anode lead wires and a gap therebetween were 0.02 mm.

The insulating layer having the through-holes for connecting the anode lead wires to the anodes was formed on the substrate S1 having the anode lead wires thereon. The insulating layer can be a glass frit layer formed by a screen printing method or a $SiO_x$ layer formed by a CVD (Chemical Vapor Deposition) method. In case of the CVD method, the thickness of the $SiO_x$ layer can be in the range of 0.01 $\mu$m to several $\mu$m. In this example, the thickness was 1.0 $\mu$m. In case of insulating layer formed by a CVD method, the through-holes can be formed therein by the photolithography method. The thickness of the glass flit layer made by the screen printing method can be set to be in the range from several $\mu$m to several tens of $\mu$m.

Al layer is formed on the insulating layer by a PVD (Physical Vapor Deposition) or a sputtering method. In this example, the Al layer was formed by the sputtering method. The thickness of the Al layer can be in the range from 0.01 μm to several μm and in this example, the thickness was 1.0 μm. The grids with the openings and the anodes provided inside the openings were simultaneously formed from the Al layer by a photolithography method. In addition, when the Al layer was formed, Al also filled the through-holes to thereby connect the corresponding anodes to the anode lead wires.

A fluorescent layer, whose size is 120 μm×120 μm, was coated on each anode by a slurry method. By the process as described above, the anode lead wires, the insulating layer, the anodes and the grids were formed on the first substrate formed of a glass material.

In case of the first substrate S1 having a plurality of recesses, a step of forming recesses on the first substrate S1 is carried out prior to the step of forming the anode lead wires. The remaining steps are identical to those described above. The recesses are formed by etching the first substrate S1 with BHF (Buffered HF), and the depth of the recesses is in the range of several μm to several tens of μm. In this example, the depth was 10 μm. When forming the recesses on the first substrate S1, the surface of the first substrate S1 except the recesses is processed to become rough so that the non-recessed surface becomes a anti-reflecting surface. In that case, commonly used anti-reflecting filter becomes unnecessary.

Figure 7A:
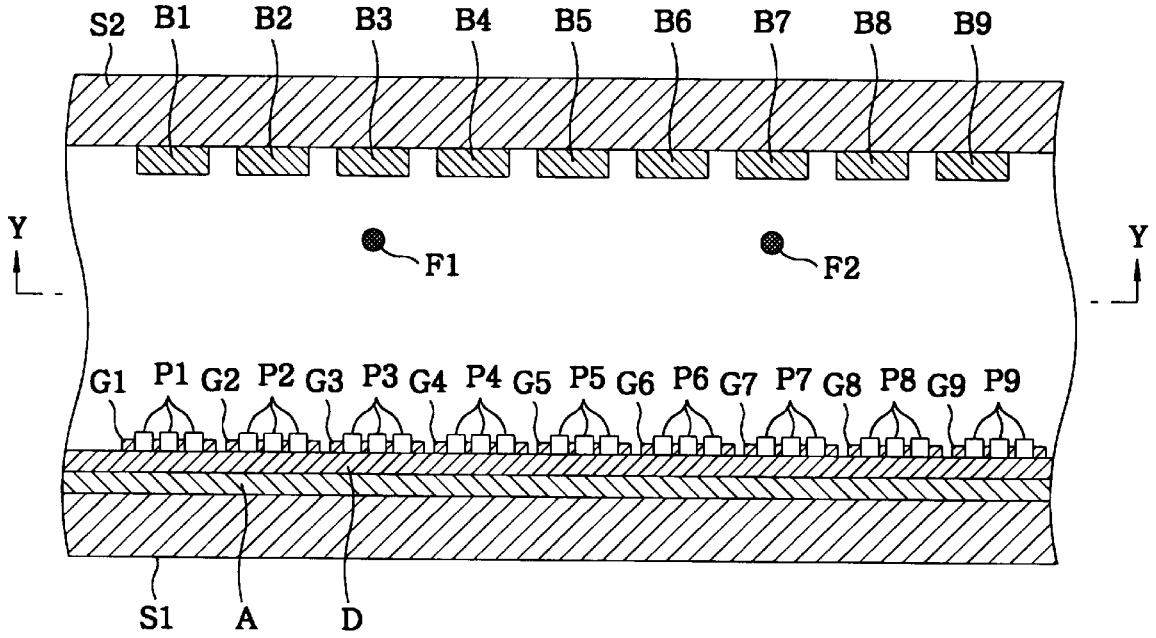
FIGS. 7A and 7B show a cross sectional view and a top view of the graphic fluorescent display device in accordance with the third preferred embodiment of the present invention.
Figure 7B:
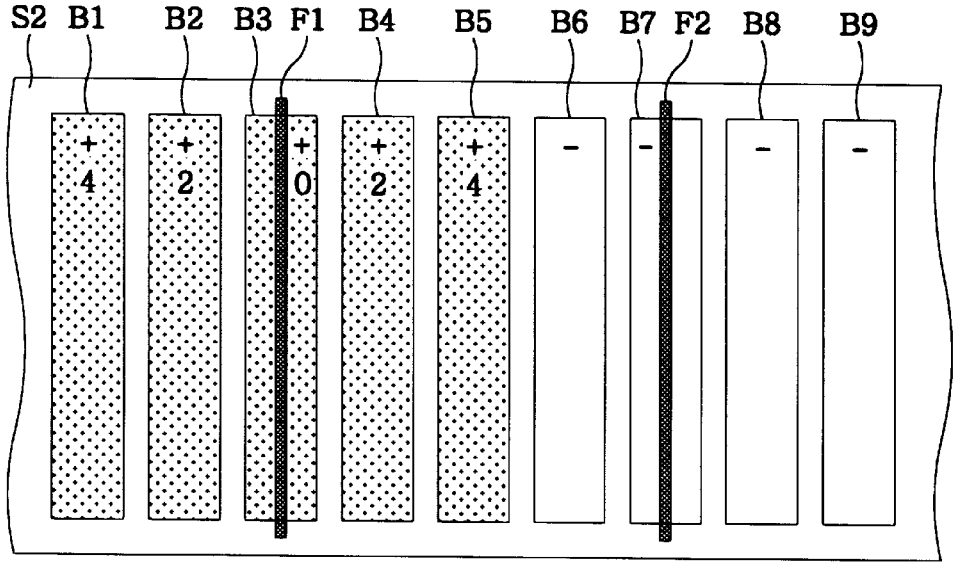

FIG. 7A shows a cross sectional view of the graphic fluorescent display device in accordance with the third preferred embodiment of the present invention. FIG. 7B is a top view of the graphic fluorescent display device taken along the line Y—Y in FIG. 7A.

Reference notation S1 represents the first substrate; A, an anode lead wire; D, the insulating layer; G1 to G9, the grids; P1 to P9, the fluorescent layers deposited on the anodes (not shown); F1 and F2, the filaments functioning as cathodes; S2, a second substrate; and B1 to B9, rear electrodes. Each of the fluorescent layers P1 to P9 represent three fluorescent layers provided on the anodes controlled by a same grid. For example, the fluorescent layers P1 represents three fluorescent layers deposited on three anodes controlled by the grid G1.

The insulating layer D, the anode lead wire A, anodes (not shown), the grids G1 to G9 and the fluorescent layers P1 to P9 are formed on the first substrate S1 in an identical manner as described with reference to FIGS. 3 to 6. The stripe-shaped rear electrodes B1 to B9 are formed on the second substrate S2 to be in parallel with the filaments F1 and F2 and the grids G1 to G9. The first substrate S1 is placed opposite to the second substrate S2 with respect to the filaments F1 and F2 intervened therebetween.

A negative or a positive potential of several tens of voltages is applied to the rear electrodes B1 to B9 to control the electron emission from the filaments F1 and F2. For instance, the rear electrodes B1 to B5 control the filament F1 and the rear electrodes B6 to B9 control the filament F2. For instance, if the filament F1 is selected to emit electrons and the filament F2 is selected to not emit the electrons, a positive control voltage, i.e., a filament selection voltage, is applied to the rear electrodes B1 to B5 and a negative control voltage, i.e., a filament non-selection voltage, is applied to the rear electrodes B6 to B9. The filament F2 is under the influence of the negative electric field so that electron emission from the filament F2 is halted.

The filament selection and non-selection voltages are respectively set to be in the ranges from an electric potential of the filament (here, 0 V to several volts) to a positive several tens of volts and to a negative several tens of volts.

As shown in FIG. 7A, since the distances from the filament F1 to the closest fluorescent layer P3 and those for the fluorescent layers P1, P2, P4 and P5 on both sides of P3 from the filament F1 are different from each other, the amounts of electrons emitted on the fluorescent layers P1 to P5 are also different when the rear electrodes B1 to B5 are set to have a same selection voltage, which in turn results in the nonuniform luminance level from the fluorescent layers P1 to P5. Accordingly, in accordance with the present invention, the control voltages having potential gradient are applied to the rear electrodes B1 to B9, so that the electrons are evenly emitted on the fluorescent layers.

FIG. 7B shows the potential gradient of the control voltages applied to the rear electrodes B1 to B9 when the filament F1 is selected to emit electrons.

In FIG. 7B, the rear electrode B3 nearest to the filament F1 is placed at 0 V (the preferable voltages of the filament is in the range from 0 V to several volts) potential; both the rear electrodes B2 and B4, +2 V; both rear electrodes B1 and B5, +4 V. By applying the control voltages having potential gradient to the rear electrodes, electrons from the filaments can evenly spread electrons across the fluorescent layers.

Further, in FIG. 7, the rear electrodes B1 to B9 have two functions of selecting a filament and distributing electrons therefrom evenly, yet it is also possible for the rear electrodes to have only one function of distributing electrons evenly.

In the embodiments described in FIGS. 3 to 7B, the driving method of the anodes and the grids can be accomplished by either applying data signals into the anodes while scanning the grids or applying data signals into the grids while scanning the anodes.

In the graphic fluorescent display devices of the present invention, since the anodes, grids and insulating layer are thin films at least, it becomes possible to manufacture graphic fluorescent display devices having high resolution while suppressing the charge-up level of the insulating layer.

While the invention has been shown and described with respect to the preferred embodiments, it will be understood by those skilled in the art that various changes and modifications may be made without departing from the spirit and scope of the invention as defined in the following claims.

What is claimed is:

1. A fluorescent display device comprising:

a first substrate;

an insulating layer formed on the first substrate;

n columns of m anodes, each anode having a fluorescent layer thereon;

Q anode lead wires provided for each column of the m anodes, every Qth anodes being connected to a same anode lead wire; and z grids, Z being a positive integer equal to or greater than m/Q but smaller than (m/Q)+1, formed on the insulating layer, each grid being arranged across the n columns of m anodes, each grid being provided with openings for each column of m anodes, each opening exposing a portion of the insulating layer and one anode being formed on the exposed portion of the insulating layer, wherein the insulating layer, the anodes, the anode lead wires and grids are thin films.

2. The fluorescent display device of claim 1, further comprising at least one cathode and wherein a surface of the fluorescent layer is closer to the cathode than surfaces of the grids facing the anode lead wire.

3. The fluorescent display device of claim 1, wherein the first substrate has a plurality of recesses formed thereon and the grids have recessed portions being overlapped with the recesses in the recesses of the first substrate, the recessed portions of the grids having openings on bottoms thereof.

4. The fluorescent display device of claim 3, wherein the recessed portions of the grids have slanted side walls.

5. The fluorescent display device of claim 1, further comprising a second substrate having a surface facing the first substrate, the facing surface of the second substrate being provided with a plurality of stripe shaped rear electrodes to which control voltages are applied.

6. The fluorescent display device of claim 5, wherein the control voltages have a potential gradient.

* * * * *